United States Patent [19]

Finley et al.

[11] Patent Number: 4,602,917

[45] Date of Patent: Jul. 29, 1986

[54] FORMCOKE HAVING MODIFIED BITUMINOUS BINDER

[75] Inventors: Joseph H. Finley, Metuchen, N.J.; Richard R. Severns; Robert M. Zakotnik, both of Kemmerer, Wyo.

[73] Assignee: FMC Corporation, Philadelphia, Pa.

[21] Appl. No.: 725,465

[22] Filed: Apr. 22, 1985

[51] Int. Cl.[4] ..... C10L 5/02; C10L 5/14

[52] U.S. Cl. ..... 44/10 C; 44/15 B

[58] Field of Search ..... 44/1 F, 15 B, 23, 10 C

[56] References Cited

U.S. PATENT DOCUMENTS

| | | | |
|---|---|---|---|
| 719,830 | 2/1903 | Meade | 44/15 R |
| 720,600 | 2/1903 | Morrow | 44/19 |
| 1,507,676 | 9/1924 | Nagel | 44/16 D |
| 1,590,706 | 6/1926 | Spencer | 44/16 R |
| 2,040,609 | 5/1936 | Holz | 44/15 |
| 2,314,641 | 3/1943 | Wolf | 202/34 |
| 3,140,241 | 7/1964 | Work et al. | 202/26 |
| 3,140,242 | 7/1964 | Work et al. | 202/26 |
| 3,403,989 | 10/1968 | Blake et al. | 44/23 |
| 4,008,053 | 2/1977 | Brenneman et al. | 44/1 D |
| 4,152,119 | 5/1979 | Schulz | 44/1 D |

FOREIGN PATENT DOCUMENTS

| | | | |
|---|---|---|---|
| 232399 | 9/1959 | Australia | 44/15 B |
| 2071662 | 9/1971 | France | 44/15 B |

*Primary Examiner*—Carl F. Dees

*Attorney, Agent, or Firm*—Robert D. Jackson; Frank Ianno

[57] ABSTRACT

Formcoke is produced by separately introducing feedstocks of calcined coal particles, bituminous binder and a carbohydrate, preferably an aqueous sugar, into a mixing zone. The resulting mixture is compacted into shapes, such as briquettes, which are then cured in an oxygen-containing atmosphere and optionally heated to coking temperatures.

6 Claims, No Drawings

FORMCOKE HAVING MODIFIED BITUMINOUS BINDER

This invention relates to formcoke. More particularly, the invention pertains to improvements in supplemental binders for use as an adjunct to the bituminous binder in the manufacture of formcoke.

Formcoke is well-known in the fuel and in the metallurgical arts where it is widely employed as a reductant in the smelting of ores. Although various types have been described, essentially all formcoke is obtained by compressing a mixture of particulate carbon and a binder into appropriate shapes, a common configuration being that of pillow briquettes. Depending on their end use, such briquettes may require subsequent treatment to increase hardness and durability. For instance, metallurgical grade formcoke is obtained by heating, first at curing and then at coking temperatures, compacted shapes composed of coal derived particulate carbon and a bituminous binder.

A metallurgical grade of formcoke of exceptionally high quality and which is manufactured commercially, is described in U.S. Pat. Nos. 3,140,241 and 3,140,242 to Work et al. In producing this formcoke, coal particles are subjected to three sequential heat treatments to give reactive calcined coal particles, tar vapors and gases. The tar vapors are condensed and the resulting tar oxidized and dehydrated to produce pitch for use as a binder. This is mixed with the calcined coal particles and pressed into briquettes which are heated in an oxygen-containing atmosphere to effect polymerization of binder and coal char and give hardened briquettes. These can be converted to the final formcoke product by heating at coking temperatures in a nonreactive atmosphere.

In a typical operation of producing formcoke according to the Work et al patents, bituminous coal, including noncoking coals, of a particle size less than 6 mesh (U.S. Standard Sieve Series) and preferably less than 16 mesh with the average particle size in the range of from 40 to 60 mesh, is heated in the presence of oxygen, which may be derived from the coal itself in the case of the so-called high oxygen-containing coals, that is, coals having an excess of 15% by weight of oxygen, to a temperature high enough to drive off substantially all moisture but below that at which substantial amounts of tar-forming vapors evolve. Thereafter, the coal particles from this heat treatment are heated to a higher temperature at which tar-forming vapors are evolved and for a time interval sufficient to effect polymerization of the heated coal particles and evolution therefrom of substantially all of the tar-forming vapors to produce a char of markedly lower volatile combustible material content than the parent coal and substantially free of tar-forming vapors. This char is heated to a still higher temperature to produce the calcined char particles for blending with the bituminous binder. Calcining is typically conducted at about 760° C. to 982° C. for about 20 to 30 minutes.

The calcined char is mixed with the binder in the proportions of from 75% to 90% calcined char to 25% to 10% binder. These percentages are based on the weight of the total mix. Preferred binders are coal tar pitch or pitches produced by condensation of tars from the gases evolved during the carbonization and the subsequent dehydration, stripping, and/or oxidation of the resultant tars to produce pitches having a softening point of from 38° C. to 107° C. (ASTM Ring and Ball).

The blend of calcined char and binder is compressed to produce green briquettes which are then cured in an atmosphere containing oxygen to bring about copolymerization of the binder and the char so as to make the briquettes strong and infusible. Typically, curing is effected at about 195° C. to 250° C. for about two hours. The cured briquettes are coked to produce briquettes suitable for metallurgical purposes. Typically, coking is conducted at about 800° C. to 900° C. for about 20 minutes. The briquettes thus produced, when observed even under a relatively low power magnification, are of uniform composition, that is, as a general rule the carbon derived from the calcined char and that derived from the bituminous binder are indistinguishable.

A more detailed description of the aforesaid process of producing formcoke is given in the cited U.S. Pat. Nos. 3,140,241 and 3,140,242, the disclosure of which is incorporated herein by reference.

When producing briquettes from bituminous coals having insufficient volatile matter to furnish enough tar to supply the binder requirements for the process, a supplemental source of a suitable binder must be used. Many bituminous binders, including parafinic asphalts and some asphalts ordinarily used for making green briquettes, when used alone or when blended with the pitch binder derived from the tar produced in the carbonization stage of the process, are unsatisfactory because they do not polymerize (or copolymerize) sufficiently well in the oxidative curing step to harden the green briquette and cause it to become infusible. In some cases, these unsatisfactory binders solidify during oxidative curing but they do not bond the char particles together sufficiently well to give a strong cured briquette. In either case, the result is cured briquettes having low crushing strength which on coking are unsatisfactory for metallurgical purposes.

Generally speaking, it has been the conventional thinking in the art that supplemental binders, used for preparing formcoke, must be compatible with the main bituminous binder. See, for instance, U.S. Pat. No. 3,403,989 which discloses certain petroleum derived asphalts that are compatible with the bituminous binder used in producing the formcoke of the aforecited Work et al patents. Various coal tar pitches obtained as byproducts in the manufacture of oven coke are also compatible with bituminous binders but these are quite costly owing to the marked rise in the price of coal tar products in recent years. Even petroleum asphalts, at least of the type having the requisite compatibility, are not inexpensive.

Manifestly, the economics of formcoke production stand to benefit from the development of a low cost binder which can be used as a supplement or extender for bituminous binders.

The discovery has now been made that supplementary binders which are not compatible with bituminous binders can be utilized in preparing formcoke and the provision of such formcoke and a method of producing it constitutes the principal object and purpose of the invention. Other objects and purposes of the invention will be apparent from the ensuing description.

The objects aforesaid can be realized in accordance with the invention by introducing a supplementary binder described hereinafter into the mixing zone of a formcoke plant separately from the bituminous binder feed stream. The supplementary feed stream requires no substantive changes in either the design or operation of the formcoke plant. Basically, the supplementary binder feed unit consists of a suitable reservoir for containing the binder material which is conveyed therefrom as a liquid via a feed line to the mixing zone. The physical layout of the supplementary binder feed system is simple to operate and can be installed as a low cost add-on item to an existing formcoke plant. The material from the mixer is conveyed to the compacting zone where it is compressed into green formcoke shapes which can be cured and coked in the normal manner. There is no substantial diminution in strength or durability of the cured or coked shapes, their properties being essentially identical to the specifications of formcoke as produced heretofore.

So far as can be determined, supplementary binders suitable for practicing the invention include those materials which undergo carbonization to yield fixed carbon at the temperature at which the green shapes from the compacting zone are cured and/or coked. As above pointed out, the supplementary binder need not be compatible with the main bituminous binder. In general, the supplementary binder will be an organic compound which chars at elevated temperatures.

It has been found that on a solids weight basis from about 3% to about 38% of the bituminous binder can be replaced with the supplementary binder and still give formcoke of satisfactory quality. Normally, the percentage of supplementary binder will fall in the range of about 5% to about 20% solids. For ease and convenience of adding and mixing, the supplementary binder is preferably employed as an aqueous fluid which can be a solution or a slurry or both and having a total solids content by weight of from about 20% to about 80%.

Among the substances which have been tested and found to give excellent results when used as a supplement for bituminous binders are the carbohydrates, particularly the various classes of sugars, for example, mono-, di-, trisaccharides, etc. Especially preferred because of their low cost and ready availability are the waste products of sugar refining and in this connection nonfood grade molasses has proved exceptionally effective. Nonfood grade molasses is a by-product recovered in the manufacture of sugar from sugar beets. It is a dark, viscous aqueous liquid having a solids content by weight of about 70% to 80%.

It is believed that the use of supplementary binder as provided by the invention is generally applicable to formcoke made from particulate carbon and a bituminous binder. From a practical standpoint, however, the invention is desirably employed as an adjunct to the commercial manufacture of high quality metallurgical formcoke such as that of the Work et al patents. By substituting the supplemental binders in accordance with the invention for the expensive compatible asphalts and pitches to make up for in-house binder shortage, the economics of formcoke production is considerably improved.

In carrying out the invention, formcoke is prepared in the normal manner by introducing particulate carbon and bituminous binder into a mixing zone except that provision is made for adding a separate feed stream of the supplementary binder.

Taking the formcoke briquettes and the production thereof as given in the Work et al patents as typical and representative, calcined coal char or calcinate and liquid bituminous binder are fed into a suitable machine, such as a pug mill, while simultaneously and separately introducing therein a stream of molasses.

The percentage of tar and supplemental binder required to produce formcoke briquettes of a given strength depends on various factors. Among these may be mentioned particle size distribution, surface area and porosity of the particulate carbon and its reactivity, that is, its capacity to copolymerize with the binder under curing conditions. The calcined coal char used in the manufacture of formcoke by the Work et al process exhibits such reactivity to a marked degree.

As an illustration of the effect of particle size, formcoke pellets exhibited marked reduction in crushing strength as the percentage of 100 mesh carbon fines was increased at a given binder percentage.

The temperature at which the particulate carbon and binders are blended also influence the strength of formcoke. Temperature affects binder viscosity and hence the extent to which it is absorbed in the fine pore structure of the carbon particles. If an excessively large percentage is absorbed, little binder remains to coat the carbon particles with the result that they do not adhere sufficiently to one another and thus resist compaction under briquetting pressures. Generally speaking, satisfactory grades of formcoke can be obtained at briquetting temperatures in the range of about 75° C. to 100° C.. Preferred briquetting temperatures are in the 90° C. to 100° C. range.

The amount of bituminous binder used in manufacturing metallurgical formcoke such as that of the Work et al patents is about 10% to 25% by weight of the green briquette composition. Where the bituminous binder drops below about 10%, dry, fragile briquettes result whereas binder in excess of about 25% gives soft briquettes which tend to agglomerate when subjected to curing. Preferred bituminous binder levels are about 13% to 20%. When preparing formcoke in accordance with the invention, about 5% to about 20% of the bituminous binder is replaced with the herein supplementary binder which is desirably a solution or slurry such as beet sugar molasses. In a typical operation, bituminous material and the molasses are metered from separate orifices situated approximately 2–3 inches apart into the center of the mixer into which the carbonaceous solids are continuously fed. The solids feed enters the mixer at temperatures well above the normal softening point of the bituminous binder (54° to 66° C.) as determined by ASTM Ring and Ball test. Binders and solids are blended at temperatures in the neighborhood of 75° C. to 100° C., preferably 90° C. to 100° C.

Test and Evaluation Procedures

Mechanical strength is a key factor in evaluating the quality of formcoke. In determining mechanical strength, three properties are normally measured: (1) crushing strength, (2) Rotap abradability and (3) tumbler index. Crushing strength values afford meaningful strength comparisons for cylindrical pellets owing to their consistent size and measurable flat surfaces. A cylindrical pellet is the shape of formcoke commonly utilized in conducting laboratory tests and collecting experimental data. On the other hand, commercially manufactured pillow briquettes are less amendable to comparisons of crushing strength because of their irregular shapes and size variations. Consequently, Rotap and tumbler index tests are employed in comparing briquette properties. Comparisons generally consist of strength measurements made with and without the supplementary binder of the invention. Pellets and briquettes were prepared from a common stock of particulate carbon in order to eliminate variations due to sizing, porosity or surface area differences. The test procedures aforesaid are summarized below:

(1) Crushing Strength

Crushing strength is determined by applying pressure to each of the parallel flat surfaces of a cylindrical pellet of formcoke at a rate of 0.05 inch per minute in an Instron Universal Tester. The pressure at which the pellet fractures is recorded and converted to pounds/inch$^2$ (PSI), based on measurement of the flat surface area.

(2) Rotap Abradability

Twenty-five representative briquettes are weighed to the nearest 0.1 gm and placed in a #6 Tyler standard screen. The screen is covered with a lid and shaken for 10 minutes in a Tyler Rotap Testing Sieve Shaker. The coke retained on the screen is weighed. The percentage of −6 mesh coke produced by abrasion is calculated from the formula:

$$\% -6 \text{ mesh} = 100 - \frac{\text{wt. retained}}{\text{wt. sample}} \times 100$$

Values of 6% or less −6 mesh fraction indicate good strength properties for coked briquettes in this test.

(3) Tumbler Index

The percentage of minus $\frac{1}{4}$ inch coke produced on tumbling briquettes by a standardized method (ASTM Standard 1958, D294-50 p. 1102) is measured in this test. Briquettes are tumbled at 24±1 RPM for a total of 700 revolutions. Tumbler index values of 30% or less are indicative of good briquette strength. However, values up to about 40% are considered as acceptable.

The invention is further illustrated by the following nonlimiting examples.

EXAMPLE 1

Effect of Molasses Supplementation on Crushing Strength

Calcined coal char (calcinate), prepared by the procedure of U.S. Pat. Nos. 3,140,241 and 3,140,242 and having the following particle size distribution, was used in this example.

| Sieve Size (USS Series) | Cumulative Percent |
|---|---|
| on 8 mesh | 3.4 |
| on 18 mesh | 32.9 |
| on 30 mesh | 48.1 |
| on 50 mesh | 65.7 |
| on 100 mesh | 77.6 |

Pellet Preparation

Calcinate (350.0 grams) was warmed to 90° C. to 100° C. in an oven, and combined with sufficient warm (80° C.) molasses to give the desired supplementary binder level (Table I). Hot (150° C.) bituminous binder, obtained by the process of the aforecited patents, was then added to bring the overall binder level up to 18.0%. The mixture was agitated for about seven minutes in a Hobart blender while maintaining the temperature at or about 75° C. by means of a heating mantle. In most cases, pellets were prepared by compressing 15.0 gram portions of the mixture in a prewarmed $1\frac{1}{8}$ inch die at 6000 pounds pressure in a Carver Press. This generally resulted in pellets of approximately one inch in height.

Additional pellets were prepared in a similar manner using an 18.0% level of the bituminous binder alone.

Post Treatment

The pellets were cured by heating in a bed of finely divided (−4 mesh) coke at 200° C. to 230° C. for two hours in the presence of air. Coking was effected by heating the pellets under nitrogen (600 cc/min) at 800° C. for 0.5 hour in a Lindberg Type 54233 tube furnace. The pellets were then cooled under nitrogen.

Crushing strength values obtained at an 18% overall binder level and two supplementary binder concentrations are shown in Table I. The average crushing strength is not only undiminshed but actually appears to be increased by substituting the bituminous binder of the patents with up to 75% of the molasses supplementary binder.

TABLE I

Effect of Molasses* Supplementation on Crushing Strength

| Binder Concentrations, % | | | Crushing Strength, PSI | |
|---|---|---|---|---|
| Tar | Molasses | Total | Values | Av. Value |
| 18.0 | 0 | 18.0 | 600 | |
| " | " | " | 705 | |
| " | " | " | 873 | |
| " | " | " | 1012 | 798 |
| 9.0 | 9.0 | 18.0 | 696 | |
| " | " | " | 702 | |
| " | " | " | 729 | |
| " | " | " | 1131 | 815 |
| 4.5 | 13.5 | 18.0 | 901 | |
| " | " | " | 967 | |
| " | " | " | 1055 | |
| " | " | " | 1208 | 1033 |

*Discard beet molasses from Holly Sugar Co., Torrington, Wyoming.

Production of Formcoke Briquettes

Formcoke briquettes were produced at FMC's Kemmerer, Wyoming Plant by means of the process set forth in U.S. Pat. Nos. 3,140,241 and 3,140,242 in which part of the bituminous binder was replaced with molasses as supplementary in accordance with the invention herein. The coke plant was operated in the usual way except for the addition of the molasses. Introduction of the molasses and the fluid bituminous material was through separate feed tubes connected to suitable holding tanks. The feed lines terminated at the pug mill briquetting machine where the lines were spaced about 2 to 3 inches apart where they entered the orifice of the machine. Flow rates were controlled by means of mechanical valves. Flow rates were determined periodically by collecting tar and molasses for timed intervals and weighing the resulting specimens. Appropriate adjustments were made as needed to maintain binder ratios and total binder concentration.

Supplementation levels of 12.5%, 25.0% and 37.5% with an overall binder concentration of 15% were targeted as the objectives in Plant Tests 1–3, respectively. The supplementation level is defined as the percentage of supplementary binder in the total solids-free binder composition.

In the following examples, formcoke was produced in two mixing/briquetting units, termed B and C, which were supplied with calcinate. The molasses was stored in a warmed tank and was fed to the C-mixer only. Bituminous binder alone was supplied to the B unit during the entire test period.

Specific examples, illustrating the use of molasses as a supplementary binder as above prepared, are set forth below.

EXAMPLE 2

12.5% Molasses Supplementation (Test 1)

This test was performed for 7.5 hours under the following ranges of operating conditions:

Mixing temperature: 88.3°–98.9° C.

% Bituminous binder in mixture: 12.0–13.9% (av. 12.9%)

% Total binder in mixture: 13.6–16.1% (av. 14.7%)

Binder supplementation level: 11.3–17.7% (av. 14.4%)

Rotap test results on the coked briquettes in Table II show that the criterion for strong briquettes of 6% or less abrasion was surpassed by the coked briquettes sampled in the test. Thus, the bituminous binder level, which is normally about 14%, can be lowered to 12.9% and the deficit supplied by molasses in a commercial formcoke plant.

TABLE II

Rotap Test Results for Coked Briquettes

| Briquette Source | % Total Binder | % −6 Mesh (Rotap Test) |
|---|---|---|
| C Machine No Molasses[a] | 13.2 | 3.8 |
| C Machine With Molasses Supplementation (av. 14.4%) | 16.0 | 4.1 |
| | 16.0 | 3.4 |
| | 13.9 | 3.4 |
| | 16.1 | 4.3 |
| B Machine No Molasses[b] | 14.3 | 2.5 |

[a]Sample taken before Test 1
[b]Sample taken during Test 1

EXAMPLE 3

25% Molasses Supplementation (Test 2)

This test was performed for 19½ continuous hours under the following ranges of conditions to determine the effect of increased (vs. Test 1) molasses supplementation levels.

Mixing temperatures: 89.4°–100.0° C.

% Bituminous binder in mixture: 9.3–13.5% (av. 11.0%)

Total binder in mixture: 12.8–17.3% (av. 15.1%)

Binder supplementation level: 22.4–32.2% (av. 27.7%)

Rotap test results (Table III) show that the mechanical strength of the coked briquettes was good. As a result, bituminous binder levels can be lowered to an average of 11.4% and the deficit supplied by molasses in the event of tar shortage during operation of the formcoke plant.

TABLE III

Rotap Test Results for Coked Briquettes

| Briquette Source | % Total Binder | % −6 Mesh (Rotap Test) |
|---|---|---|
| C Machine - No Molasses[a] | 13.2 | 3.8 |
| C Machine With Molasses Supplementation (av. 27.7%) | 15.7 | 4.5 |
| | 14.8 | 4.1 |
| | 12.8 | 4.8 |
| B Machine - No Molasses[b] | 14.0 | 5.6 |

[a]Sample taken before Test 1 from C Machine
[b]Sample taken during Test 2 from B Machine

EXAMPLE 4

37.5% Molasses Supplementation (Test 3)

This test was run for 1.5 hours to evaluate the effect of still higher molasses supplementation levels than those used in Test 2. Conditions were as follows:

Mixing temperature: 89.4° C.

Bituminous binder in mixture: 10.3%

Total binder in mixture: 14.5%

Binder supplementation level: 36.6%

Test results in Table IV show that coked briquettes prepared with a high level of supplementary binder are sufficiently strong and that bituminous binder levels as low as 10.3%, with the deficit supplied by molasses, are feasible.

TABLE IV

Rotap Test Results for Coked Briquettes

| Briquette Source | % Total Binder | % −6 Mesh (Rotap Test) |
|---|---|---|
| C Machine - No Molasses[a] | 13.2 | 3.8 |
| C Machine With 36.6% Molasses Supplementation | 14.2 | 4.9 |

[a]Sample taken before Test 1 (C Machine)

EXAMPLE 5

Tumbler Index Tests

The Tumbler Index Test and Rotap tests both measure the relative resistances of coke samples to degradation by abrasion. The Tumbler Test, however, subjects coke briquettes to more drastic conditions.

Tumbler tests were performed on representative samples of coked briquettes from Tests 1 and 2. Tumbler Index values were slightly higher than the plant standard of 30% or less abraded (Table V) but were nonetheless about the same for supplemented and unsupplemented briquettes produced during the test period.

TABLE V

Tumbler Index Results - Coke Briquette

| Sample | % −¼" (Tumbler Index) |
|---|---|
| B Machine Composite (no supplementation) for Test Period | 36.8 |
| C Machine: Test 1 (14.4% av. supplementation) | 35.5 |
| C Machine: Test 2 (27.7% av. supplementation) | 38.6 |

EXAMPLE 6

Effect of Supplementary Binder on Coke Composition

Binders which would result in increased moisture, volatile matter or ash content in formcoke could have an adverse effect on furnace operation during curing and coking. Thus, it was of interest to determine the effect of molasses supplementation on the levels of these constituents in the formcoke plant tests.

Analyses were performed by the Proximate Method, using the automated Leco Mac 400 Analyzer modification of the following ASTM procedures:

Moisture Content: ASTM 3173-73

Volatile Matter: ASTM D-3175-73

Ash Content: ASTM D-3174-73 and fixed carbon was calculated from the equation:

$$100-(\text{moisture}+\text{volatile matter}+\text{ash})$$

Data in Table VI show that moisture, ash, volatile matter and fixed carbon were not significantly affected by the use of molasses as a supplementary binder.

TABLE VI

| Proximate Analysis of Coked Briquettes | | | | |
|---|---|---|---|---|
| Briquette Sample | % Moisture | % Volatile Matter | % Ash | % Fixed Carbon |
| C Machine-Before Test | 2.1 | 5.6 | 10.0 | 82.3 |
| Test 1: 14.4% | | | | |
| Av. Supplementation Level (4 samples) | 2.1 | 5.6 | 10.0 | 82.3 |
| | 2.0 | 5.3 | 9.9 | 82.8 |
| | 2.5 | 5.4 | 9.7 | 82.4 |
| | 2.1 | 5.4 | 10.1 | 82.4 |
| B Machine (no molasses) During Test 1 | 1.9 | 5.1 | 10.2 | 82.8 |
| Test 2: 27.7% | | | | |
| Av. Supplementation Level (3 samples) | 2.0 | 5.4 | 10.3 | 82.3 |
| | 2.3 | 5.8 | 9.5 | 82.4 |
| | 2.2 | 5.5 | 10.7 | 81.6 |
| B Machine (no molasses) During Test 2 | 2.2 | 5.4 | 9.7 | 82.7 |
| Test 3: 36.6% | | | | |
| Av. Supplementation Level (1 sample) | 1.9 | 5.2 | 10.2 | 82.7 |

What is claimed is:

1. A process of producing formcoke which comprises the steps of (1) separately introducing into a mixing zone on a total solids weight basis from about 75% to about 90% of calcined coal char and about 10% to about 25% of a binder mixture consisting essentially of from about 97% to about 62% of a bituminous binder and from 3% to about 38% of a carbohydrate which undergoes charring on being heated to give fixed carbon; (2) subjecting the resultant mixture to sufficient pressure to produce compacted green shapes and (3) curing the green shapes in an oxygen-containing atmosphere.

2. The process of claim 1 wherein the compacted shapes are pillow briquettes.

3. The process of claim 2 wherein the carbohydrate is a sugar.

4. The process of claim 3 wherein the carbohydrate is molasses from beet sugar refining and having a solids content by weight of about 50% to 80%.

5. A process of producing metallurgical formcoke briquettes which comprises the steps of (1) separately introducing into a mixing zone on a weight basis from about 75% to about 90% of calcined coal char and about 10% to about 25% of a binder mixture consisting essentially of from about 60% to about 90% of a bituminous binder and from about 10% to about 40% of molasses from beet sugar refining; (2) subjecting the resultant mixture to sufficient pressure to produce compacted green briquettes; (3) curing the green briquettes in an oxygen-containing atmosphere and (4) coking the cured briquettes by heating them to coking temperatures in a nonreactive atmosphere.

6.

The process of claim 5 wherein the calcined coal char is obtained by heating coal particles below tar-forming temperatures in a first stage under oxidizing conditions; heating the oxidized coal particles in a second stage to carbonizing temperatures to effect evolution of tar-forming vapors and heating the carbonized coal particles in a third stage to calcining temperatures to give calcined coal particles of reduced volatile content and wherein the bituminous binder is derived by the dehydration, stripping and/or oxidation of the evolved tar from the carbonization aforesaid until a pitch is obtained having an ASTM Ring and Ball softening point of from 38° C. to 107° C.

* * * * *